US010015602B2

(12) United States Patent
Croghan et al.

(10) Patent No.: US 10,015,602 B2
(45) Date of Patent: Jul. 3, 2018

(54) SYSTEMS AND METHODS FOR IMPROVING OUTPUT SIGNALS FROM AUDITORY PROSTHESES

(71) Applicants: Naomi Croghan, Macquarie University (AU); Zachary Smith, Macquarie University (AU)

(72) Inventors: Naomi Croghan, Macquarie University (AU); Zachary Smith, Macquarie University (AU)

(73) Assignee: COCHLEAR LIMITED, Macquarie University (AU)

( * ) Notice: Subject to any disclaimer, the term of this patent is extended or adjusted under 35 U.S.C. 154(b) by 0 days.

(21) Appl. No.: 15/246,416

(22) Filed: Aug. 24, 2016

(65) Prior Publication Data

US 2017/0064465 A1 Mar. 2, 2017

Related U.S. Application Data

(60) Provisional application No. 62/210,329, filed on Aug. 26, 2015.

(51) Int. Cl.
*H04R 25/00* (2006.01)

(52) U.S. Cl.
CPC ..... *H04R 25/456* (2013.01); *H04R 25/305* (2013.01); *H04R 25/453* (2013.01); *H04R 25/505* (2013.01); *H04R 25/65* (2013.01)

(58) Field of Classification Search
CPC .. H04R 25/456; H04R 25/453; H04R 25/305; H04R 25/505; H04R 25/65
USPC ..... 381/60, 23.1
See application file for complete search history.

(56) References Cited

U.S. PATENT DOCUMENTS

| | | | |
|---|---|---|---|
| 6,512,834 | B1 | 1/2003 | Banter et al. |
| 6,932,187 | B2 | 8/2005 | Banter et al. |
| 7,065,224 | B2 | 6/2006 | Cornelius et al. |
| 7,415,121 | B2 | 8/2008 | Mogelin et al. |
| 7,580,537 | B2 | 8/2009 | Urso et al. |
| 7,756,285 | B2 | 7/2010 | Sjursen et al. |
| 8,091,680 | B2 | 1/2012 | Killion et al. |
| 8,111,852 | B2 | 2/2012 | Ho et al. |

(Continued)

FOREIGN PATENT DOCUMENTS

| | | |
|---|---|---|
| WO | 2011033136 A2 | 3/2011 |
| WO | 2014107734 A2 | 7/2014 |

OTHER PUBLICATIONS

Chasin, Marshall, "Amplification fit for music lovers", The Hearing Journal, Sep. 2010, vol. 63, pp. 27-30.

(Continued)

*Primary Examiner* — David Ton
(74) *Attorney, Agent, or Firm* — Merchant & Gould P.C.

(57) ABSTRACT

Attenuation covers are used to reduce the amplitude of input signals at a microphone or other sound-receiving component of an auditory prosthesis. The auditory prosthesis detects distortion present in the output signal from sound processing components and notifies a recipient that an attenuation cover is recommended or desirable. Use of the cover can provide a clearer output signal to the recipient, so as to improve the recipient experience. Such covers can be particularly useful in environments where the input sound signals exceed the dynamic range of the auditory prosthesis.

20 Claims, 14 Drawing Sheets

(56) References Cited

U.S. PATENT DOCUMENTS

| | | | | |
|---|---|---|---|---|
| 8,340,323 | B2 * | 12/2012 | Asada | H04R 1/1041 381/103 |
| 8,739,926 | B1 | 6/2014 | Mori | |
| 2010/0208927 | A1 | 8/2010 | Ritter et al. | |
| 2013/0077808 | A1 | 3/2013 | Bashkaran et al. | |
| 2013/0108097 | A1 | 5/2013 | Neilson et al. | |
| 2014/0091406 | A1 | 4/2014 | Harney et al. | |
| 2014/0376761 | A1 | 12/2014 | Godfrey | |

OTHER PUBLICATIONS

Chasin, Marshall & Russo, Frank A., "Hearing aids and music", Trends in Amplification, 2004, vol. 8,No. 2, pp. 35-47.

Hockley, Neil S. et al., "Analog-to-digital conversion to accommodate the dynamics of live music in hearing instruments", 2012, Trends in Amplification, vol. 16, No. 3, pp. 146-158.

* cited by examiner

SYSTEMS AND METHODS FOR IMPROVING OUTPUT SIGNALS FROM AUDITORY PROSTHESES

BACKGROUND

Hearing loss, which can be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient (i.e., the inner ear of the recipient) to bypass the mechanisms of the middle and outer ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or the ear canal. Individuals suffering from conductive hearing loss can retain some form of residual hearing because some or all of the hair cells in the cochlea function normally.

Individuals suffering from conductive or sensorineural hearing loss often receive a conventional hearing aid. Such hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to conventional hearing aids, which rely primarily on the principles of air conduction, certain types of hearing prostheses commonly referred to as bone conduction devices, convert a received sound into vibrations. The vibrations are transferred through the skull to the cochlea causing motion of the perilymph and stimulation of the auditory nerve, which results in the perception of the received sound. Bone conduction devices are suitable to treat a variety of types of hearing loss and can be suitable for individuals who cannot derive sufficient benefit from conventional hearing aids.

SUMMARY

Aspects disclosed herein relate to attenuation covers that are used to reduce the amplitude of input signals at a microphone or other sound-receiving component of an auditory prosthesis. Sound processing or other components in the auditory prosthesis can detect distortion present in the output signal and notify a recipient of the auditory prosthesis that an attenuation cover is recommended or desirable. Use of such a cover can provide a clearer output signal to the recipient, so as to improve the recipient experience. Attenuation covers can be particularly useful in environments where the input sound signals exceed the dynamic range of the auditory prosthesis.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

The same number represents the same element or same type of element in all drawings.

DETAILED DESCRIPTION

The technologies disclosed herein can be used in conjunction with various types of auditory prostheses, including active transcutaneous bone conduction devices, passive transcutaneous devices, middle ear devices, cochlear implants, totally implantable cochlear implants, and acoustic hearing aids (that are disposed within the ear or supported from the ear). In general, any type of auditory prosthesis that utilizes a microphone, transducer, or other sound-receiving component can benefit from the technologies described herein. Additionally, the technologies can be incorporated into other devices that receive sound and send a corresponding stimulus to a recipient. The corresponding stimulus can be in the form of electrical signals, mechanical vibrations, or acoustic sounds. For clarity, however, the technologies disclosed herein will be generally described in the context of microphones used in behind-the-ear auditory prostheses, as used in conjunction with a cochlear implant.

Figure 1:
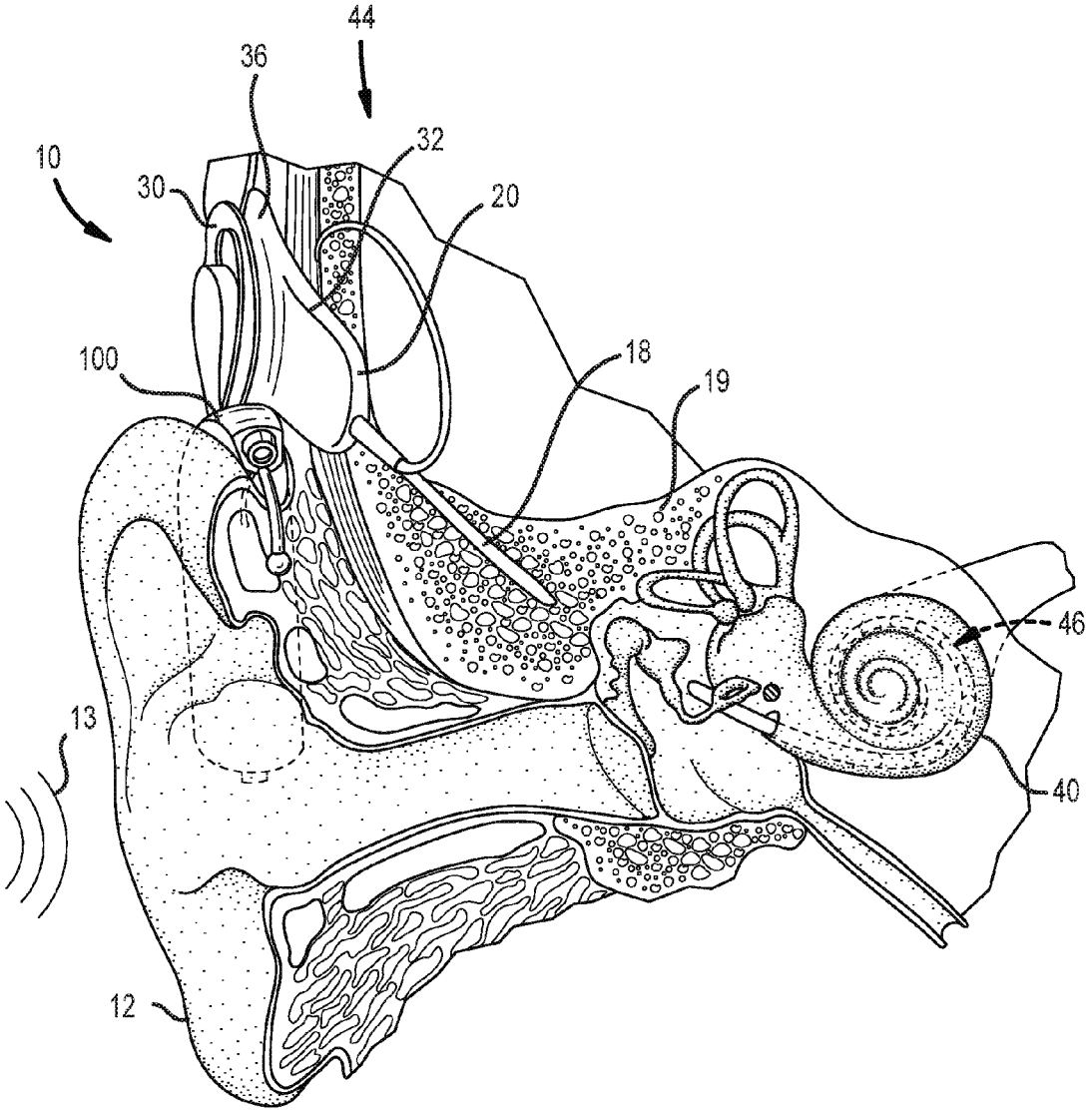
FIG. 1 is a partial view of an auditory prosthesis worn on a recipient.

Referring to FIG. 1, cochlear implant system 10 includes an implantable component 44 typically having an internal receiver/transceiver unit 32, a stimulator unit 20, and an elongate lead 18. The internal receiver/transceiver unit 32 permits the cochlear implant system 10 to receive and/or transmit signals to an external device 100 and includes an internal coil 36, and preferably, a magnet (not shown) fixed relative to the internal coil 36. These signals generally correspond to external sound 13. Internal receiver unit 32 and stimulator unit 20 are hermetically sealed within a biocompatible housing, sometimes collectively referred to as a stimulator/receiver unit. The magnets facilitate the operational alignment of the external and internal coils, enabling internal coil 36 to receive power and stimulation data from external coil 30. The external coil 30 is contained within an external portion attached to a head of a recipient. Elongate lead 18 has a proximal end connected to stimulator unit 20, and a distal end implanted in cochlea 40. Elongate lead 18 extends from stimulator unit 20 to cochlea 40 through mastoid bone 19.

In certain examples, external coil 30 transmits electrical signals (e.g., power and stimulation data) to internal coil 36 via a radio frequency (RF) link, as noted above. Internal coil 36 is typically a wire antenna coil comprised of multiple turns of electrically insulated single-strand or multi-strand platinum or gold wire. The electrical insulation of internal coil 36 is provided by a flexible silicone molding. Various types of energy transfer, such as infrared (IR), electromagnetic, capacitive and inductive transfer, can be used to transfer the power and/or data from external device to cochlear implant.

There are a variety of types of intra-cochlear stimulating assemblies including short, straight and peri-modiolar. Stimulating assembly 46 is configured to adopt a curved configuration during and or after implantation into the recipient's cochlea 40. To achieve this, in certain arrangements, stimulating assembly 46 is pre-curved to the same general curvature of a cochlea 40. Such examples of stimulating assembly 46, are typically held straight by, for example, a stiffening stylet (not shown) or sheath which is removed during implantation, or alternatively varying material combinations or the use of shape memory materials, so that the stimulating assembly can adopt its curved configuration when in the cochlea 40. Other methods of implantation, as well as other stimulating assemblies which adopt a curved configuration, can be used.

Stimulating assembly can be a peri-modiolar, a straight, or a mid-scala assembly. Alternatively, the stimulating assembly can be a short electrode implanted into at least in basal region. The stimulating assembly can extend towards apical end of cochlea, referred to as cochlea apex. In certain circumstances, the stimulating assembly can be inserted into cochlea via a cochleostomy. In other circumstances, a cochleostomy can be formed through round window, oval window, the promontory, or through an apical turn of cochlea.

Speech processing components, such as microphones, speech processing hardware and software, and other elements, can be disposed within a housing separate from the implantable portion of the auditory prosthesis. In certain examples, such components can be contained in an external portion that also includes the external coil described above. In another example, the sound processing components can be contained within a so-called behind-the-ear (BTE) device, such as BTE 100 depicted in FIG. 1. In the latter case, signals from the sound processing components are sent to an external portion containing the external coil. Both an external portion containing sound processing components and a BTE containing sound processing components are described below in FIGS. 1A and 1B, respectively. The technologies described further herein can be incorporated into either type of devices, as required or desired for a particular application.

Figure 1A:
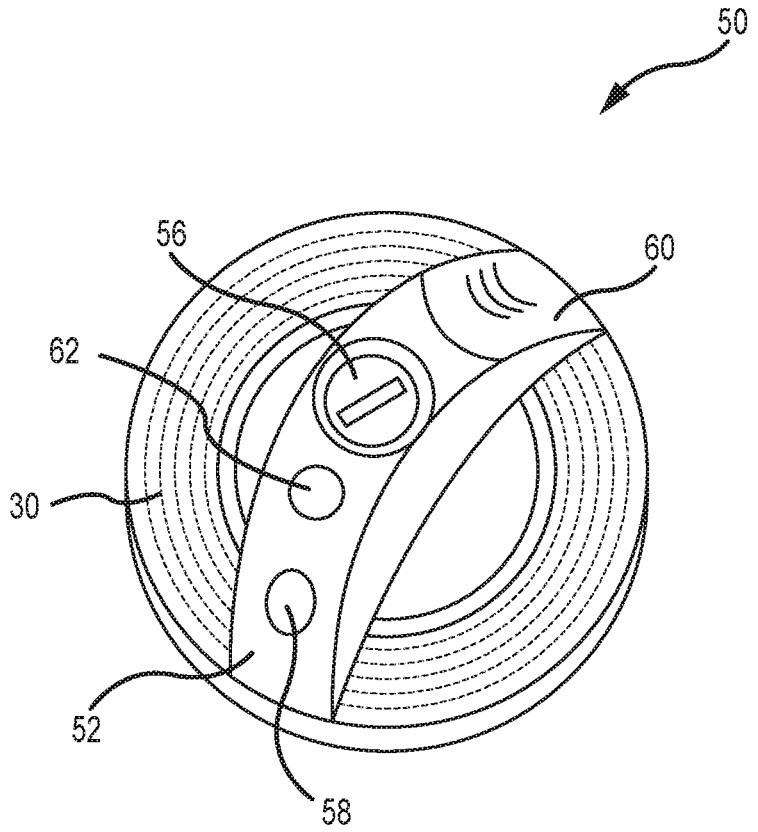
FIG. 1A is a side perspective view of an external portion of an auditory prosthesis.

FIG. 1A is a perspective view of type of an external portion 50 of an auditory prosthesis. The external portion 50 includes a body 52 and the external coil 30 connected thereto. The function of the external coil 30 is described above with regard to FIG. 1. The body 52 can include a permanent magnet 56 as described above, which helps secure the external portion 50 to the recipient's skull. The external portion 50 can include an indicator 58 such as a light emitting diode (LED). A battery door 60 covers a receptacle that includes a battery that provides internal power to the various components of the external portion 50 and the implantable portion. A microphone 62 receives sound that is processed by sound-processing components within the external portion 50.

Figure 1B:
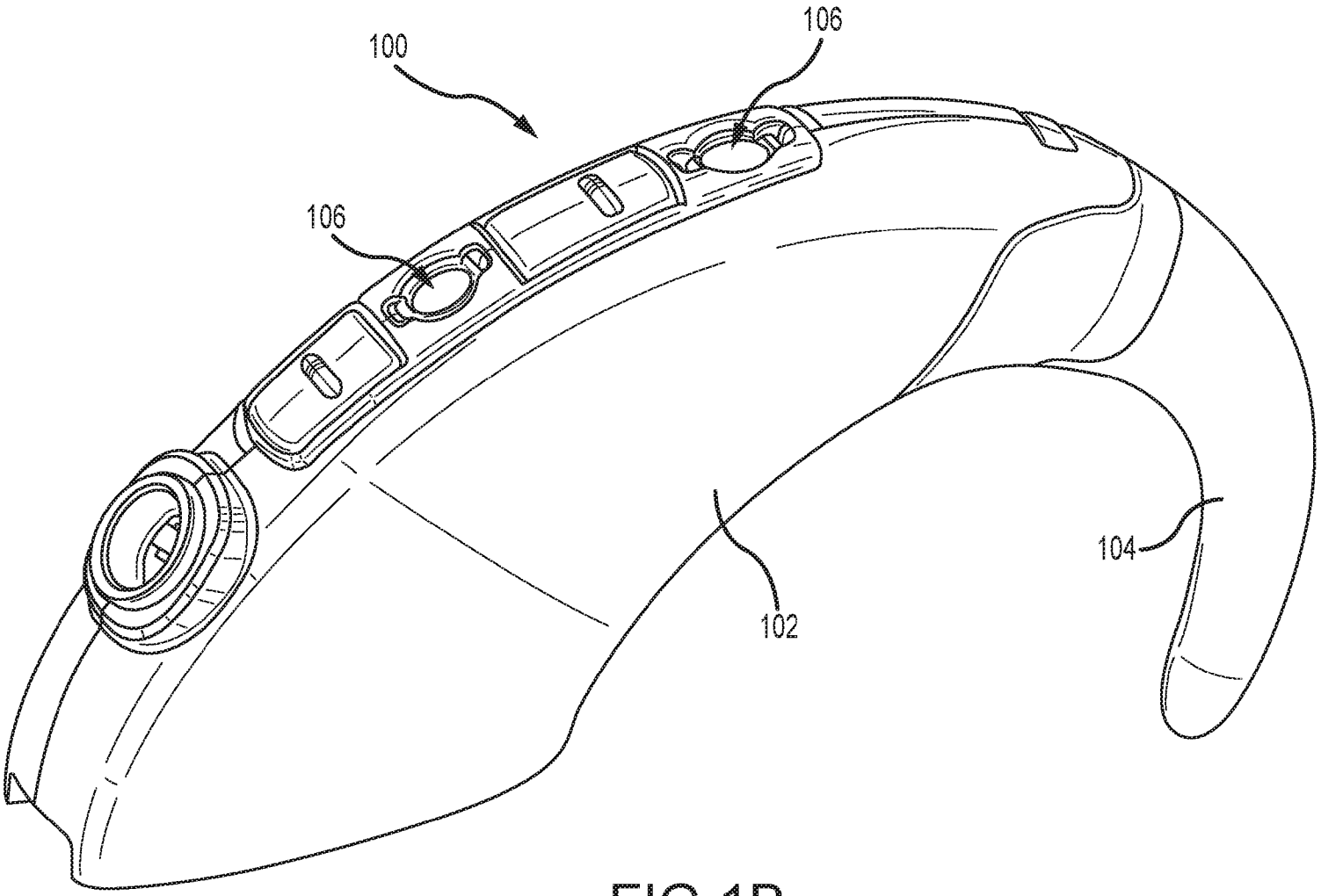
FIG. 1B is a side perspective view of a behind-the-ear portion of an auditory prosthesis.

FIG. 1B depicts another type of an external portion 100 (more specifically, a BTE) of an auditory prosthesis. The BTE 100 includes a housing 102 and an ear hook 104 extending therefrom to help secure the BTE 100 to the ear of a recipient. The ear hook 104 helps secure the BTE 100 to a recipient by wrapping around the upper portion of the ear. The housing 102 of the BTE 100 defines one or more openings 106 that allow sound to travel into the housing 102, to a microphone or other sound-receiving element disposed therein. These openings 106 form a penetration in the housing 102 that can allow water, dirt, or other debris to enter the housing 102. Such ingress can damage the microphone and/or other elements within the housing 102. In the depicted embodiment, the openings 106 are depicted as round in shape, but openings having other shapes are contemplated. The technologies described herein are described in the context of microphones utilized in the BTE 100 that is worn on the ear of a recipient, even though, as noted above, the technologies can be utilized with external portions that also contain the external coil.

Figure 2A:
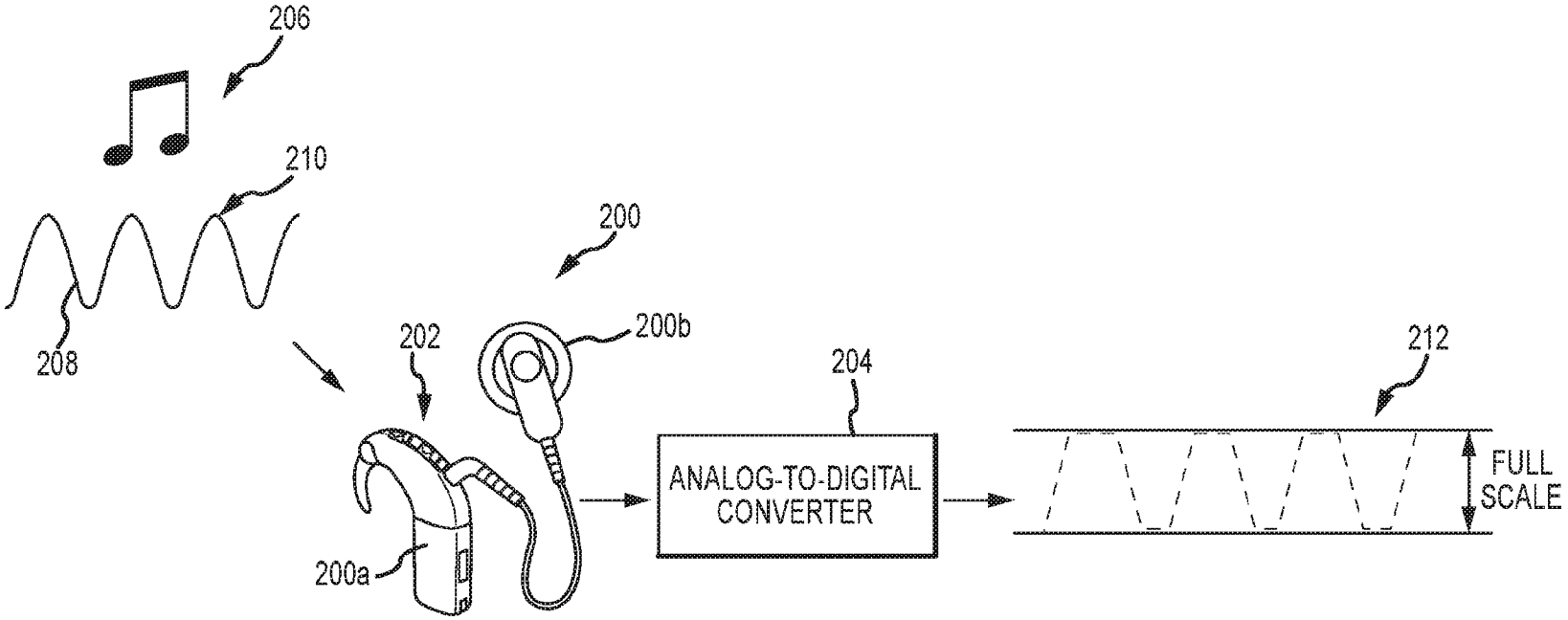
FIG. 2A is a schematic depiction of distorted output of an auditory prosthesis.

FIG. 2A is a schematic depiction of distorted output of an auditory prosthesis 200, which is depicted generally as a BTE device 200*a* connected to an external coil 200*b*. As described above, any type of auditory prosthesis, as well as traditional hearing aids, can be utilized. The auditory prosthesis 200 includes, at a minimum, a microphone in communication with at least one microphone opening 202 in the BTE device 200*a* and speech processing components including at least an analog-to-digital converter 204 (depicted outside the auditory prosthesis 200 for illustrative purposes). In general, an auditory prosthesis 200 performs generally better when delivering stimuli in quieter environments. The sound quality of live music 206, however, is often compromised for a number of reasons. Live music 206 is generally a more intense input signal 208 than recorded music or speech and often has higher crest factors than speech, meaning that the peaks 210 of the input signal 208 are much higher in comparison to the average sound input levels. As such, the peaks 210 of live music input signals 208 can be well over a sound pressure level (SPL) of 100 dB. The live music input signals 208 pass into the microphone opening 202 in the BTE device 200, where they are received by the microphone and processed. The digital architectures of the sound processors of the auditory prosthesis 200 (e.g., the analog-to-digital converter 204) result in a fixed dynamic range. In an example, 16 bits can represent a dynamic range of up to about 90 dB. Because the peaks 210 of the live music input signals 208 are frequently above the top of this dynamic range, the live music signal 208 is often peak-clipped at the analog-to-digital converter 204, causing distortion. The distortion is present at the output of the analog-to-digital converter 204 as a clipped output signal 212. Once this distortion is present, further software and sound coding manipulations cannot restore the "clean" signal, leading to reduced sound quality for recipients. Thus, known sound processing technologies that reduce sensitivity, volume, or other sound characteristics cannot adequately modify the input signal 208 so as to obtain a desired output signal.

Figure 2B:
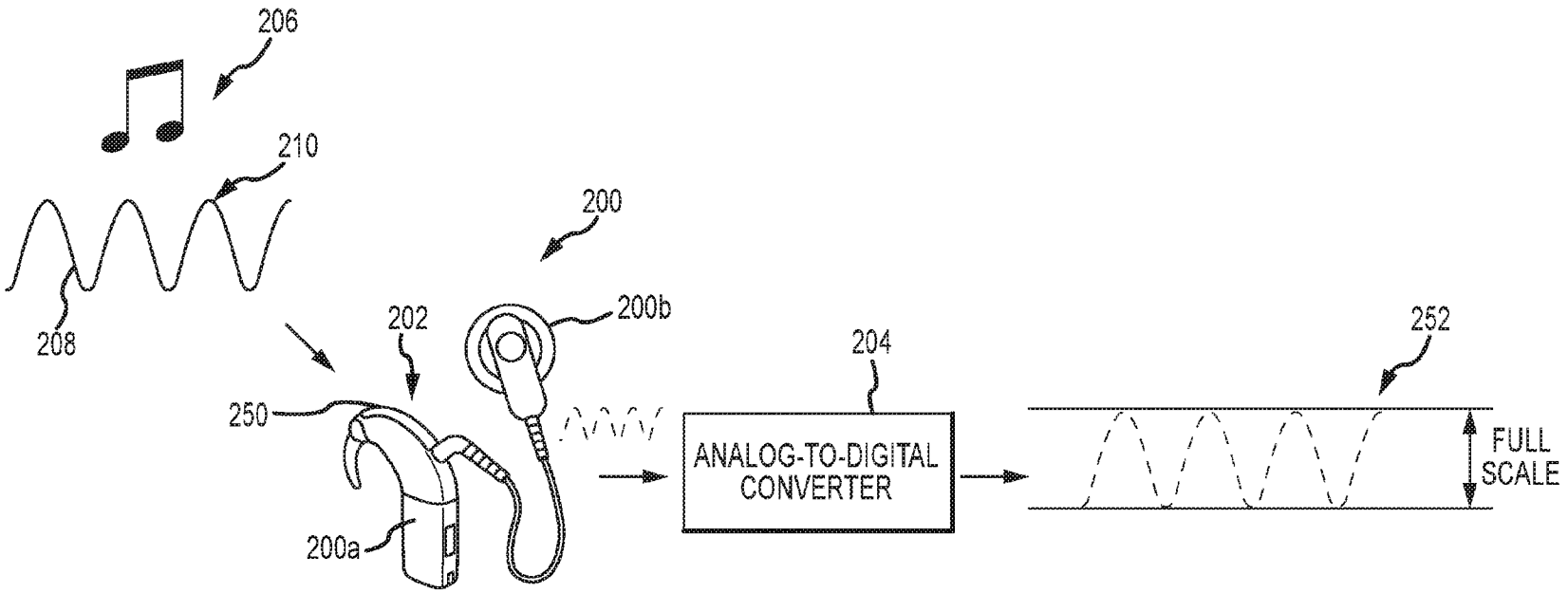
FIG. 2B is a schematic depiction of an output of an auditory prosthesis utilized in conjunction with an attenuation cover.

FIG. 2B is a schematic depiction of an output of an auditory prosthesis 200 utilized in conjunction with an attenuation cover 250. Many of the components depicted in FIG. 2B are described with regard to FIG. 2A and are therefore not necessarily described further. The attenuation cover 250 reduces the front-end peak-clipping that routinely occurs in live music environments and is depicted and described above in FIG. 2A. When listening to live music, the recipient can place the attenuation cover 250 over the microphone openings 202 of the auditory prosthesis 200 to attenuate the level of the input signal 208. Different types and configurations of attenuation covers are contemplated and described in further detail below. In the depicted embodiment, the attenuation cover 250 is an external, removable component that is designed to be used as required or desired. In one example, the attenuation cover 250 has a flat frequency response so that the spectrum of the music 206 is left intact. When the attenuation cover 250 is attached and in place, the attenuated level of the input signal 208 will be within the dynamic range of the analog-to-digital converter 204. Therefore, the incoming music input signal 208 will be preserved upon entering the sound processing components, leading to improved fidelity in the music output signal 252. This less distorted signal 252 (or in certain examples, entirely undistorted signal) will enhance perceived music quality for the recipient. The signal 252 can be further processed, if required or desired, for a particular application.

Figure 3A:
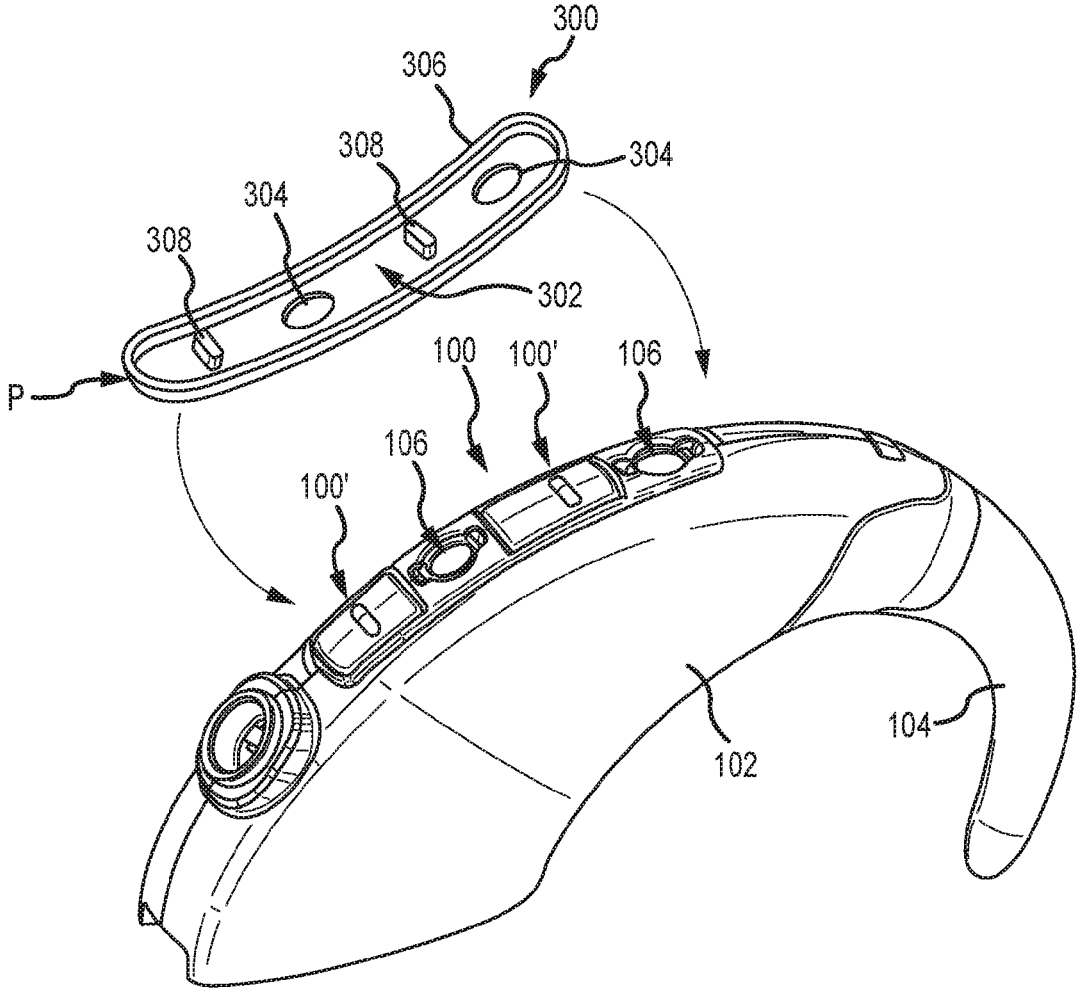
FIG. 3A is a side perspective view of the behind-the-ear portion of FIG. 1B and an example of an attenuation cover.

FIG. 3A is a side perspective view of the BTE portion 100 of FIG. 1B and an example of an attenuation cover 300. Various components of the BTE portion 100 are described above with regard to FIG. 1B and are not necessarily described further. In addition to the components described above, one or more openings 100' are formed within a portion of the housing 102, proximate the microphone openings 106. The purposes of these openings 100' are described below. The attenuation cover 300 has a generally rigid body 302 that is sized to cover one or more of the microphone openings 106 that are defined by the housing 102. The rigid body 302 can have known attenuation properties as described in more detail below. To prevent attenuated sound from reaching the microphone openings 106 (and accordingly, the microphones), it is desirable that the rigid body 302 or portions thereof form a sealed volume at the microphone openings 106. Such a sealed volume can be formed over each microphone opening 106, with a plurality of sealing elements 304. Alternatively, the sealed volume can be formed over both microphone openings 106, together, with a single sealing element 306. In the depicted embodiment, sealing element 306 is disposed about a perimeter P of the rigid body 302, although other locations are contemplated. In certain examples, sealing elements 304, 306 can both be included to ensure an adequate seal. The sealing elements 304, 306 form an uninterrupted contact surface with the housing 102 and can be formed of a resilient gasket or other element that is generally secured to the rigid body 302. A removable adhesive can be disposed on a face of the sealing element 304, 306 to ensure further contact with the housing 102.

The sealing elements 304, 306 are configured to contact and uncontact from the housing without damaging either the attenuation cover 300, the rigid body 302, the sealing elements 304, 306 themselves, the housing 102, and so on. Easy application and removal of the attenuation cover 300 is desirable because the covers described herein are configured to be applied and removed as circumstances dictate. Thus, it is desirable that this occurs without damaging the housing or leaving adhesive residue on any portion of the device. It is also advantageous that the covers described herein be applied and removed without requiring the recipient to remove their auditory prosthesis. The attenuation cover 300 can also include one or more keys 308 projecting therefrom that are configured to mate with the openings 100'. This mating engagement is described in further detail below and can be used to secure the cover 300 to the device 100, or to trigger a signal that can be used by the BTE 100 to identify the type of cover 300 being utilized, performance characteristics (e.g., attenuation characteristics), and so on. In other examples, a signal can be triggered by RFID elements, proximity sensors, electrical contacts, or other components, disposed in either or both of the attenuation cover 300 or the device 100.

Figure 3B:
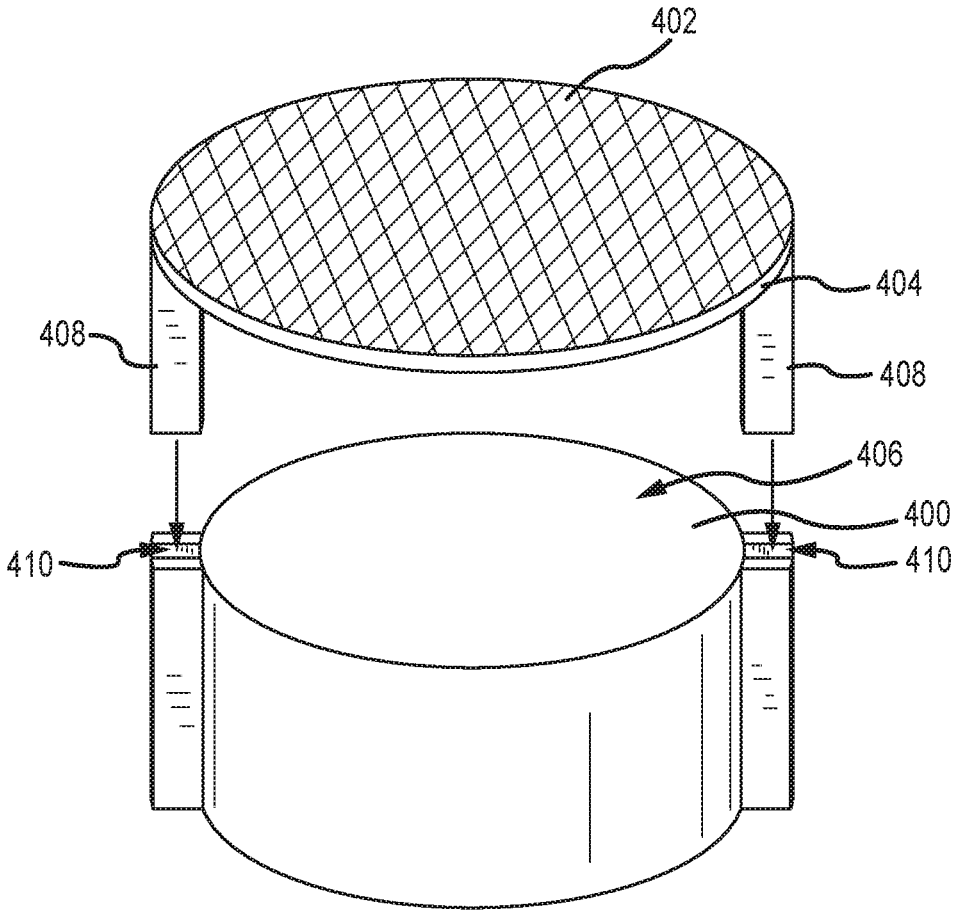
FIG. 3B depicts a side perspective view of a microphone and another example of an attenuation cover.

FIG. 3B depicts a side perspective view of a microphone 400 and another example of an attenuation cover 402. Here, the microphone 400 can be disposed within the body of a BTE or an external portion of an auditory prosthesis. The attenuation cover 402 can include a sealing element 404 disposed on a surface thereof and configured to engage with the body (e.g., an upper surface 406) of the microphone 400 so as to form a sealed volume thereon, as described above. The attenuation cover 402 can also include one or more keys 408 configured to engage one or more keyholes or openings 410 disposed proximate the microphone 400. This engagement can secure the cover 402 to the device and/or microphone 400, trigger a signal to be used by the device, and for other purposes as described herein. Affirmative engagement of a portion of the attenuation cover 402 with either or both of the microphone 400 and the device body can help ensure a sealed volume is formed proximate the inlet to the microphone 400. In certain examples, engagement elements that provide tactile feedback (in the form of, e.g., detents or other elements) can be desirable to ensure proper engagement.

Figure 4A:
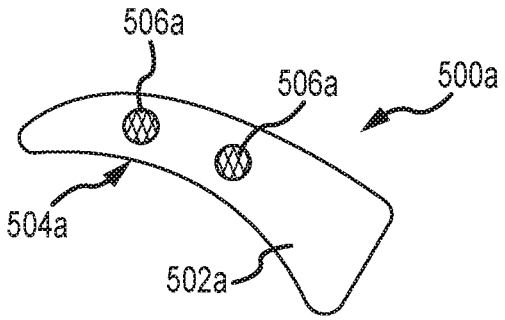
FIGS. 4A and 4B depict other examples of attenuation covers.
Figure 4B:
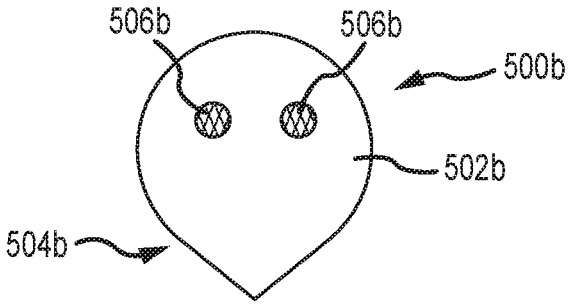

FIGS. 4A and 4B depict other examples of attenuation covers 500*a*, 500*b*. The attenuation cover 500*a* has a form factor configured to match that of a BTE device. In this example, a body 502*a* of the attenuation cover 500*a* can be manufactured of a flexible or semi-flexible material that has disposed on an underside 504*a* thereof a removable contact adhesive. This allows the attenuation cover 500*a* to be applied and removed as required or desired. The body 502*a* can include one or more substantially rigid portions 506*a* disposed so as to align with a corresponding number of microphone openings on the BTE. In an alternative example, one rigid portion 506*a* can be used to cover more than one microphone opening. Thus, the rigid portions 506*a*, in conjunction with the contact adhesive on the underside 504*a* of the body 502*a* form the sealed volume once attached to the BTE. To help ensure the desired attenuation, the rigid portions 506*a* can be oversized, relative to the microphone openings, such that when secured to the BTE device, only the rigid portions 506*a* cover the openings. Additional sealing elements in the form of thin gaskets or additional adhesive can be disposed proximate the rigid portions 506*a* to ensure a sealed volume is formed.

The attenuation cover 500*b* has a form factor configured to match that of a traditional hearing aid device that is inserted into the ear canal. Similar to the example described in FIG. 4A, a body 502*b* of the attenuation cover 500*b* can be manufactured of a flexible or semi-flexible material that has disposed on an underside 504*b* thereof a removable contact adhesive. As above, the body 502*b* can include one or more substantially rigid portions 506*b* disposed so as to cover one or more microphone openings on the device. The rigid portions 506*b* can be oversized, relative to the microphone openings on the device such that when secured to the hearing aid device, only the rigid portions 506*b* cover the openings. Additional sealing elements in the form of thin gaskets or additional adhesive can be utilized to ensure a sealed volume is formed.

Figure 5B:
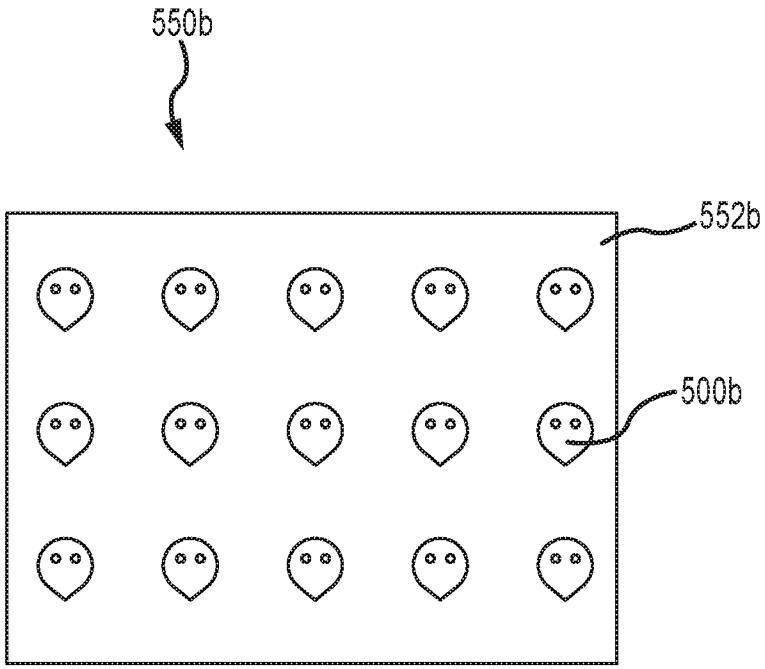
FIGS. 5A and 5B depict examples of storage systems for the attenuation covers of FIGS. 4A and 4B, respectively.
Figure 5A:
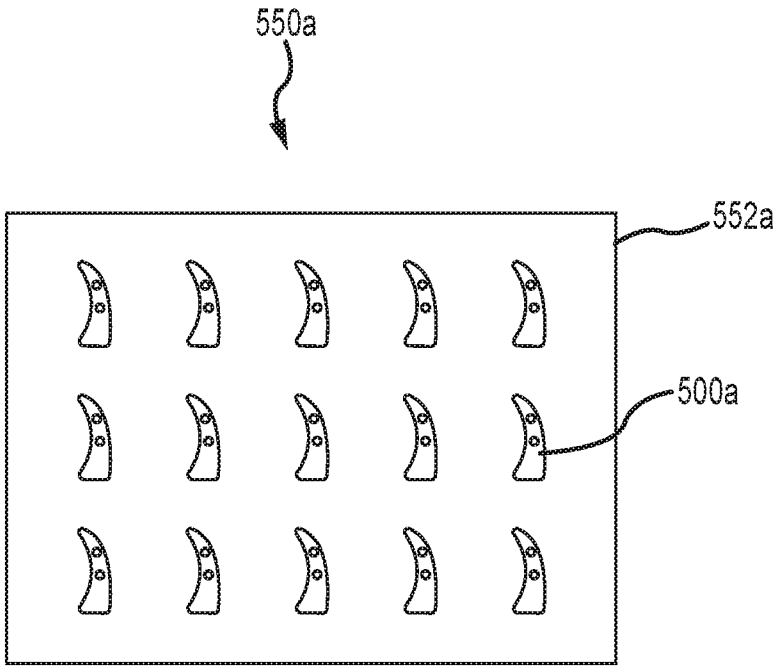

FIGS. 5A and 5B depict examples of storage systems 550*a*, 550*b* for the attenuation covers 500*a*, 500*b* of FIGS. 4A and 4B, respectively. The storage systems 550*a*, 550*b* include a releasable contact sheet 552*a*, 552*b* having a plurality of attenuation covers 500*a*, 500*b* disposed thereon. When desired, a recipient can remove an attenuation cover 500*a*, 500*b* and secure it to their device. After use, the attenuation covers 500*a*, 500*b* can be removed and discarded. In examples, a single sheet 552*a*, 552*b* can include a plurality of attenuation cases 500*a*, 500*b*, where two or more of which can display different attenuation properties. Covers 500*a*, 500*b* can be grouped in distinct areas on the sheets 552*a*, 552*b* or colored, marked, or otherwise identified.

Figure 6A:
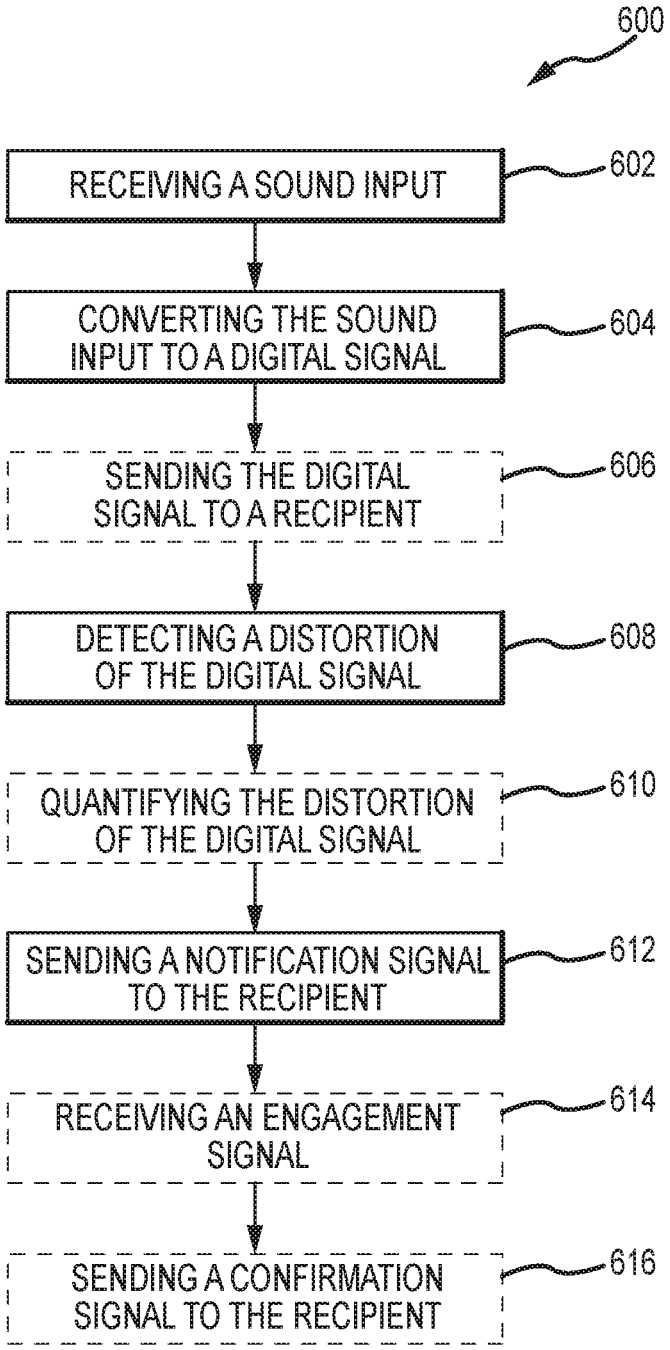
FIG. 6A depicts a method of reducing output signal distortion in an auditory prosthesis.

FIG. 6A depicts a method 600 of reducing signal output, distortion in an auditory prosthesis. The method 600 may be implemented using hardware, software, or a combination of hardware and software. The method 600 begins by receiving a sound input, generally at an auditory prosthesis, at operation 602. Flow continues to operation 604, where the received sound input is converted into a digital signal, for example, by passing the input through an analog-to-digital converter, as is common for auditory prostheses such as cochlear implants, bone conduction devices, etc. When the method is performed by a traditional hearing aid, operation 604 can be can additionally or alternatively include amplifying the received sound input. Flow continues to optional operation 606 where the digital signal is sent to a recipient. The technologies described herein further analyze and process the sound input so as to improve the experience of the prosthesis recipient. For example, at operation 608, the digital signal is analyzed to detect distortion. Detection of distortion is discussed in more detail below. At optional operation 610, a level of the detected distortion of the digital signal is quantified. Quantification of the digital signal is described in further detail below. In operation 612, a notification is sent.

The notification can be one or more of several different signals. For example, a notification signal can be a unique tone, pulse, or other signal distinct from the digital signals (and therefore the sounds being perceived by the recipient). In another example, a notification can be a termination of the digital signal sent to the recipient in operation 606. For example, the digital signal representing the stimulus to the recipient can cease completely or intermittently, so as to be noticed by the recipient. In another example, the unique tone, pulse, or signal can be followed by a termination of the digital stimulus signal. Additionally or alternatively, a notification signal can be sent to a device remote from the auditory prosthesis, such as a smartphone, which can display an alert to the recipient. Regardless of the type of notification used, the notification acts as a signal to the recipient to apply an attenuation cover to their device to mitigate the level of distortion caused by the input signal being received at the auditory prosthesis. Different notification signals can correspond to different attenuation covers. For example, a steady unique tone can signal the recipient to apply a cover that corresponds, for example, to 10 dB of attenuation. A different, perhaps intermittent, tone can signal the recipient to apply a cover that corresponds to 20 dB of attenuation.

Further operations in the method 600 can also improve recipient experience. For example, at optional operation 614 an engagement signal can be received if the recipient applies a cover having a key (such as described above). Subsequent thereto, at optional operation 616 a confirmation signal can be sent to the recipient e.g., so the recipient is ensured that the attenuation cover has been properly applied. Upon receipt of the engagement signal, the auditory prosthesis can continue to analyze the signal for distortion (e.g., repeating the method 600 beginning at operation 602). Continued distortion can cause the auditory prosthesis to send a signal for the recipient to apply an attenuation cover having greater attenuation than the first applied cover, for example.

Figure 6B:
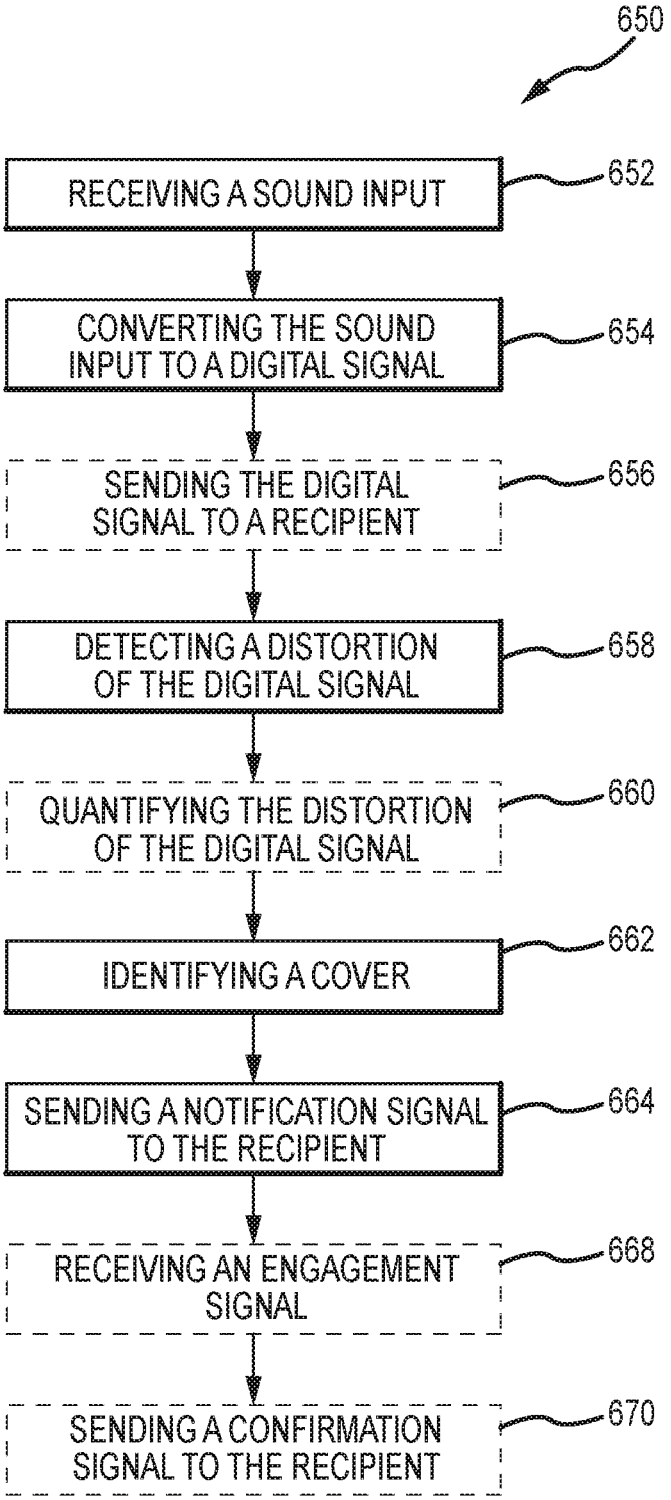
FIG. 6B depicts another method of reducing output signal distortion in an auditory prosthesis.

FIG. 6B depicts another method of reducing signal output distortion in an auditory prosthesis. The method 650 begins by receiving a sound input, operation 652, which is then converted into a digital signal, operation 654. In optional operation 656, the digital signal is sent to a recipient, operation 656. In operation 658, distortion of the digital signal is detected and in operation 660, the level of distortion of the digital signal can be quantified. In an example, optional operation 660 includes determining if the distortion is in excess of a predetermined threshold that is stored on the auditory prosthesis. Based at least in part on the quantified level of distortion, an attenuation cover displaying a known attenuation characteristic can be identified, operation 662. This cover can be selected from a plurality of covers each having known attenuation characteristics. The sound processing components of the auditory prosthesis can include a look-up table or other resource that correlates sound attenuation characteristics with particular covers.

The identification operation can include selecting an attenuation cover based on a minimum attenuation required to reduce the distortion to less than the predetermined threshold. In one example, the predetermined threshold is based on a sound pressure level (SPL). If the threshold SPL is 90 dB and the received input sound is 97 dB, the method 650 determines that a reduction of 7 dB is required to reduce the SPL to the threshold level. The component performing the method 650 can be programmed to select from, e.g., three covers with three different attenuation characteristics (e.g., Cover A, 5 dB attenuation; Cover B, 10 dB attenuation; and Cover 3, 20 dB attenuation). Thus, the system would identify Cover B as meeting the attenuation requirements. In another example, the predetermined threshold can be based on a number of distorted digital signal samples, which is described in more detail below.

Upon identifying the appropriate attenuation cover, operation 664 sends a notification can be sent to the recipient. Exemplary notifications are described above. The recipient can then apply the identified cover to her auditory prosthesis. To ensure the correct cover is applied by the recipient, attenuation covers can include markings, be color-coded, disposed on particular areas of the storage systems described above, etc. As described above, optional operation 668 receives an engagement signal and optional operation 670 sends a confirmation signal can be sent to the recipient. The auditory prosthesis can continually monitor input signals so as to detect distortion. Continued distortion can cause the auditory prosthesis to send a signal for the recipient to apply an attenuation cover having greater or lesser attenuation than the cover first applied, and/or notify the recipient when the attenuation cover can be removed without causing an adverse effect on performance.

In addition to identifying and recommending attenuation covers based on detected and/or quantified distortion, the technologies described herein can also identify attenuation covers utilizing scene classification technology, as described generally in U.S. Pat. Nos. 8,605,923 and 8,824,710, the disclosures of which are hereby incorporated by reference in their entireties. In scene classification technology, the sound processor of an auditory prosthesis or hearing aid can classify the auditory environment which the recipient is located, based on input signals received therefrom. An alert or notification can then be issued to prompt the recipient to apply the attenuator that is most appropriate for the particular environment. Attenuation covers can be optimized for use in various scenes. In non-limiting examples, attenuation covers are described below for four different auditory environments: music, speech in noise, wind, and noise. Other auditory environments are contemplated.

Figure 7A:
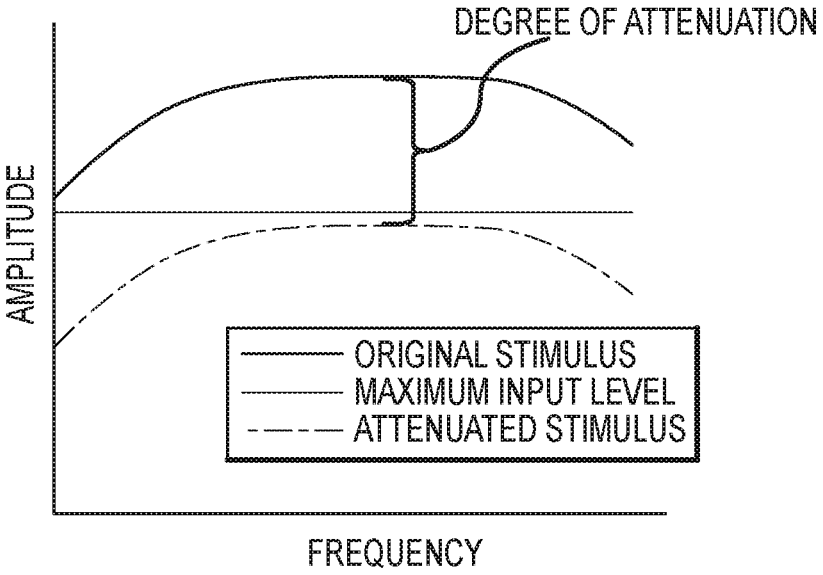
FIG. 7A is a schematic graph depicting an unmodified acoustic stimulus and a modified acoustic stimulus resulting from use of a flat attenuation cover with an auditory prosthesis.

When the auditory scene is classified as music or speech in noise, and the input signal level exceeds the input dynamic range, the auditory prosthesis can prompt or notify the recipient to apply an attenuation cover with flat attenuation characteristics that reduces the amplitude of the input signal across frequencies. FIG. 7A is a schematic graph depicting an unmodified acoustic stimulus (in the form of an input signal) and a modified or attenuated acoustic stimulus (input signal) resulting from use of such a flat attenuation cover. Here, the original input signal is above the input dynamic range of the auditory prosthesis. After placement or application of an attenuator cover, the amplitude of the input signal is reduced by an equal amount across frequencies. Flat attenuation can be appropriate for speech in noise because of the known difficulties encountered in separating speech from background noise based on frequency alone. The attenuation of the input signals will help reduce or entirely prevent front-end distortion prior to any further signal processing applied (e.g., compression, microphone directionality).

Figure 7B:
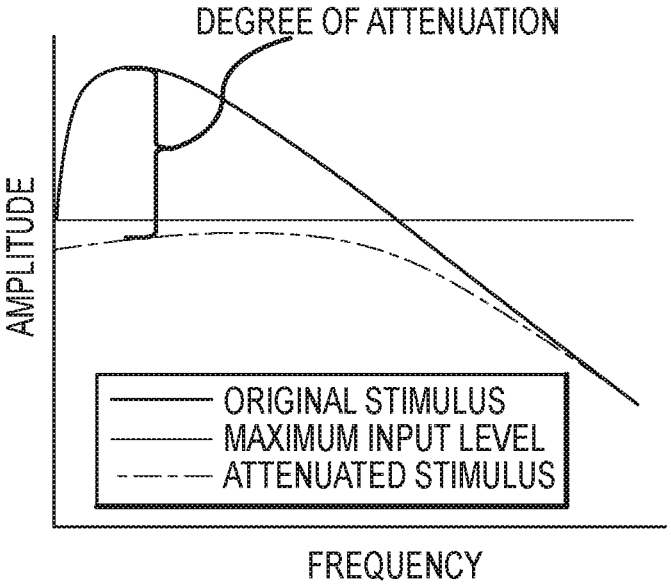
FIG. 7B is a schematic graph depicting an unmodified acoustic stimulus and a modified acoustic stimulus resulting from use of a high-pass attenuation cover with an auditory prosthesis.

Another type of scene includes those where wind or other types of steady background noise are present. These environments are often characterized by low-frequency emphasis. An attenuation cover configured for desirable performance in such a scene acts as a high-pass attenuator to reduce the low-frequency input to the microphone. FIG. 7B is a schematic graph depicting an unmodified acoustic stimulus and a modified or attenuated acoustic stimulus resulting from use of such a high-pass attenuation cover. When the auditory scene is classified as wind or noise that is above the input dynamic range, the auditory prosthesis will prompt or notify the recipient to apply an attenuation cover optimized for such an environment. The use of this type of attenuation cover can also be combined with further signal processing after the input stage (e.g., noise reduction). Thus, the technologies described herein pair scene classification with utilization of recipient-applied attenuation covers.

Figure 8:
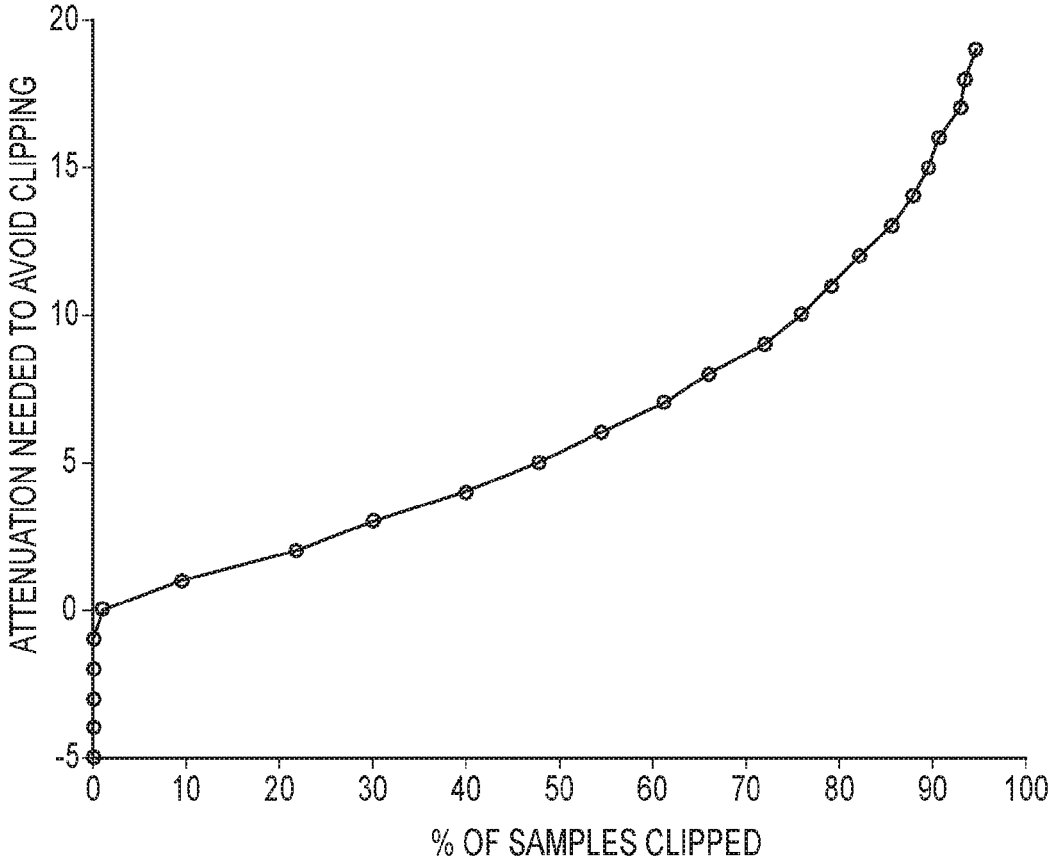
FIG. 8 is a graphical representation of an attenuation level determination algorithm.

FIG. 8 is a graphical representation of an attenuation level determination algorithm, initially described above as one method of determining whether distortion has exceeded a predetermined threshold. Here, statistics of an output signal from an analog-to-digital converter are monitored on an ongoing basis. The sound processing components or a discrete distortion detection module can estimate the peak level of distortion and send a notification to a recipient when a cover is recommended or desirable. Additionally, based on a quantification of the level of distortion, the distortion detection module can recommend an attenuation cover based on a degree of attenuation required to avoid clipping of the output signal. The algorithm can determine the ratio of samples in a given time interval that are clipped so as to estimate how far the acoustic signal is above the full-scale value of the analog-to-digital converter. Example data for maximum clipping with a sliding 8 ms time window is shown in FIG. 8 for an example music input signal. As the percentage of samples clipped during the time window increases, the algorithm determines that more attenuation is needed. Once the attenuator cover having known attenuation characteristics is installed or applied, the distortion detection module can similarly track the peak level. When the peak level falls below the digital full scale value by more than the attenuation of the cover, the recipient can be notified to remove the attenuation cover.

Figure 9:
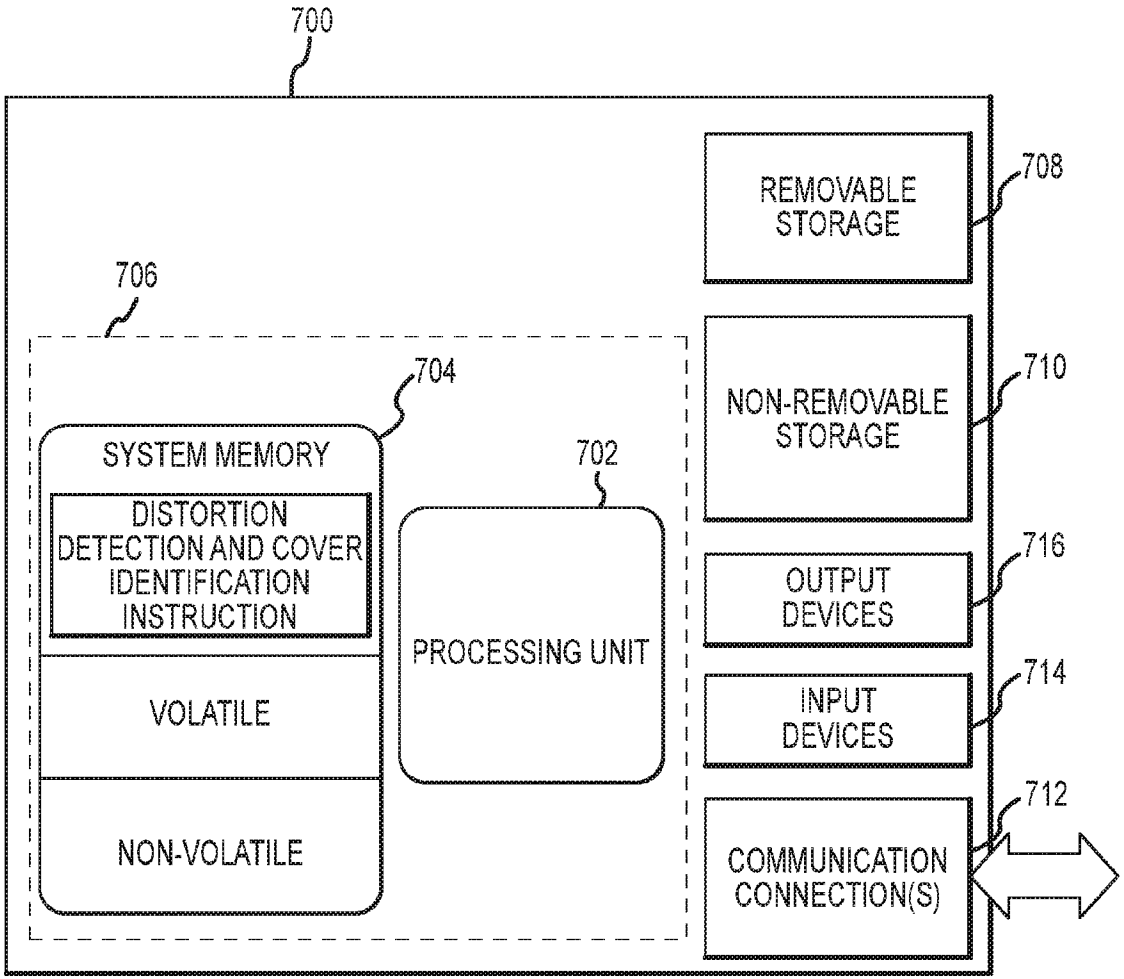
FIG. 9 depicts one example of a suitable operating environment in which one or more of the present examples can be implemented.

FIG. 9 illustrates one example of a suitable operating environment 700 in which one or more of the present embodiments can be implemented. This is only one example of a suitable operating environment and is not intended to suggest any limitation as to the scope of use or functionality. One such operating environment 700 can be the sound processor and related modules of an auditory prosthesis.

In its most basic configuration, operating environment 700 typically includes at least one processing unit 702 and memory 704. Depending on the exact configuration and type of computing device, memory 704 (storing, among other things, instructions to detect distortion and identify attenuation covers as described herein) can be volatile (such as RAM), non-volatile (such as ROM, flash memory, etc.), or some combination of the two. This most basic configuration is illustrated in FIG. 9 by line 706. Further, environment 700 can also include storage devices (removable, 708, and/or non-removable, 710). In the context of an auditory prosthesis, removable storage devices 708 can be connected, e.g., to the prosthesis via an auxiliary port. Similarly, environment 700 can also have input device(s) 714 such as touch screens, buttons or switches, microphones for voice input, etc.; and/or output device(s) 716 such as a display, indicator button stimulator unit for delivery of stimulus to a recipient, etc. Also included in the environment can be one or more communication connections, 712, such Bluetooth, RF, etc.

Operating environment 700 can include at least some form of computer readable media. Computer readable media can be any available media that can be accessed by processing unit 702 or other devices comprising the operating environment. By way of example, and not limitation, computer readable media can comprise computer storage media and communication media. Computer storage media includes volatile and nonvolatile, removable and non-removable media implemented in any method or technology for storage of information such as computer readable instructions, data structures, program modules or other data. Removable media can be connected to the auditory prosthesis via an auxiliary port. Such media is also referred to herein as "connectable media." Examples of removable (connectable) and non-removable computer storage media include, RAM, ROM, EEPROM, flash memory or other memory technology, CD-ROM, digital versatile disks (DVD) or other optical storage, magnetic cassettes, magnetic tape, magnetic disk storage or other magnetic storage devices, solid state storage, or any other non-transitory medium which can be used to store the desired information. Communication media embodies computer readable instructions, data structures, program modules, or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer readable media.

The operating environment 700 can be a single auditory prosthesis operating alone or in a networked environment using logical connections to one or more remote devices. The remote device can be, in certain examples, a smartphone, tablet, personal computer, a server, or laptop.

In some aspects, the components described herein comprise such modules or instructions executable by computer system 700 that can be stored on computer storage medium and other tangible mediums and transmitted in communication media. Computer storage media includes volatile and non-volatile, removable (connectable) and non-removable media implemented in any method or technology for storage of information such as computer readable instructions, data structures, program modules, or other data. Combinations of any of the above should also be included within the scope of readable media.

The attenuation covers described herein can be manufactured of metals such as titanium, aluminum, stainless steel, etc. Additionally, covers can be manufactured from fiber compound filters. Such filters are incorporated into the Musicians Earplugs™, available from Etymotic Research, Inc., of Elk Grove Village, Ill. Similar materials displaying attenuation characteristics desirable in the described systems and methods are utilized in the DefendEar™ line of products manufactured by Westone Laboratories, Inc., of Colorado Springs, Colo. Other acceptable materials include expanded polytetrafluoroethylene (ePTFE) utilized in Gore™ Acoustic Vents, available from W. L. Gore & Associates, Inc., of Elkton, Md. Porous plastics, glass fibers, and polymer fibers available from Porex Corporation, of Fairburn, Ga., can be utilized. Additionally, SaatiTech fabrics, manufactured by Saati Americas of Somers, N.Y., can be utilized. Attenuation covers can be coated with one or more films or coatings to improve performance or increase operable life. Hydrophobic coatings can be particularly desirable, as are coatings that increase UV light resistance to prevent degradation of the covers. Known injection molding and machining processes can be utilized. The covers can be a unitary structure or can be manufactured in multiple pieces that can be joined together with an appropriate adhesive.

This disclosure described some embodiments of the present technology with reference to the accompanying drawings, in which only some of the possible embodiments were shown. Other aspects can, however, be embodied in many different forms and should not be construed as limited to the embodiments set forth herein. Rather, these embodiments were provided so that this disclosure was thorough and complete and fully conveyed the scope of the possible embodiments to those skilled in the art.

Although specific aspects are described herein, the scope of the technology is not limited to those specific embodiments. One skilled in the art will recognize other embodiments or improvements that are within the scope of the present technology. Therefore, the specific structure, acts, or media are disclosed only as illustrative embodiments. The scope of the technology is defined by the following claims and any equivalents therein.

What is claimed is:

1. A method comprising:

receiving a sound input at an auditory prosthesis;

converting the sound input to a digital signal;

detecting a distortion level of the digital signal, wherein the distortion level represents distortion in excess of a threshold;

selecting an attenuation cover based on the distortion level, wherein the cover is selected to reduce distortion to a level less than the threshold;

sending a notification of the selected cover to a recipient; and physically receiving the attenuation cover at the auditory prosthesis, thereby forming an attachment between the cover and the auditory prosthesis.

2. The method of claim 1, wherein the converting operation comprises passing the sound input through an analog-to-digital converter.

3. The method of claim 1, wherein the sending operation comprises terminating a stimulus signal to the recipient.

4. The method of claim 1, wherein the notification comprises a tone distinct from the digital signal.

5. The method of claim 2, wherein the notification comprises a signal sent to a device remote from a device containing the analog-to-digital converter.

6. The method of claim 1, further comprising quantifying the distortion of the digital signal.

7. The method of claim 6, wherein the notification is based at least in part on the quantifying operation.

8. The method of claim 1, further comprising:

receiving an engagement signal; and sending a confirmation signal to the recipient.

9. A method comprising:

receiving a sound input at an auditory prosthesis;

converting the sound input to a digital signal;

quantifying a distortion of the digital signal;

selecting an attenuation cover based on the distortion and an attenuation characteristic of the cover;

sending a notification to a recipient; and engaging with the attenuation cover, thereby attaching the attenuation cover and the auditory prosthesis.

10. The method of claim 9, wherein the cover is selected to reduce the distortion to less than a predetermined threshold.

11. The method of claim 9, wherein the identifying operation comprises selecting the cover from a plurality of covers wherein each cover of the plurality of covers comprises a known attenuation characteristic.

12. The method of claim 11, wherein the quantifying operation comprises:

determining a distortion in excess of a predetermined threshold; and wherein the identifying operation comprises:

selecting the cover based on a minimum attenuation required to reduce the distortion to less than the predetermined threshold.

13. The method of claim 12, wherein the predetermined threshold is based at least in part on a sound pressure level.

14. The method of claim 12, wherein the predetermined threshold is based at least in part on a number of distorted digital signal samples.

15. The method of claim 11, wherein the notification comprises an indication of the selected cover.

16. The method of claim 9, wherein the notification comprises a tone distinct from the digital signal.

17. A method comprising:

obtaining a digital signal associated with a sound input at an auditory prosthesis;

determining a distortion of the digital signal in excess of a predetermined threshold;

selecting an attenuation cover based on the cover having an attenuation characteristic that reduces the distortion to less than the predetermined threshold;

sending a notification to a recipient; and securing the attenuation cover by the auditory prosthesis.

18. The method of claim 17, wherein the predetermined threshold is based at least in part on a sound pressure level.

19. The method of claim 17, wherein the predetermined threshold is based at least in part on a number of distorted digital signal samples.

20. The method of claim 17, wherein the notification comprises an indication of the selected cover.

* * * * *